US006054981A

United States Patent [19]

Kimoto et al.

[11] Patent Number: 6,054,981

[45] **Date of Patent: *Apr. 25, 2000**

[54] POWER SAVING MODES DISPLAYING APPARATUS AND METHOD

[75] Inventors: Masanobu Kimoto; Motoki Ouchiyama, both of Tokyo; Yasunori Mori, Kanagawa, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/745,939

[22] Filed: Nov. 8, 1996

[30] Foreign Application Priority Data

Nov. 9, 1995 [JP] Japan ..... P07-291520

[51] Int. Cl.[7] ..... G09G 5/00

[52] U.S. Cl. ..... 345/211; 345/83

[58] Field of Search ..... 345/211, 214, 345/212, 213, 44, 46, 82, 83; 340/815.42, 815.43, 815.45, 815.65, 815.66, 815.69; 364/707; 395/750.03, 750.05, 750.06, 750.08; 348/730

[56] References Cited

U.S. PATENT DOCUMENTS

| | | | |
|---|---|---|---|
| 5,066,929 | 11/1991 | Frantz | 340/815.45 X |
| 5,218,353 | 6/1993 | Okumura et al. | 340/815.65 |
| 5,218,607 | 6/1993 | Saito et al. | 371/66 |
| 5,318,319 | 6/1994 | Jones et al. | 273/371 |
| 5,579,252 | 11/1996 | Huang | 364/707 |
| 5,646,535 | 7/1997 | Dornier | 324/556 |

*Primary Examiner*—Chanh Nguyen
*Attorney, Agent, or Firm*—Jay H. Maioli

[57] ABSTRACT

A video display monitor having a plurality of power-save modes that are automatically controlled by a computer includes a display element for emitting light of at least two colors and circuitry for controlling the period of light emission of each color to correspond to the different power-save modes. Also, a method for displaying the power-save modes of a computer video display monitor having a plurality of power saving modes that are automatically selected by the computer uses a display element capable of emitting light of at least two colors and includes the steps of detecting a power-save mode among the plurality of power-save modes and varying the period of light emission of each color to correspond to the different detected power-save modes.

10 Claims, 4 Drawing Sheets

FIG. 3A On-Mode

FIG. 3B Standby Mode

FIG. 3C Suspend Mode

FIG. 3D Active-Off Mode

POWER SAVING MODES DISPLAYING APPARATUS AND METHOD

BACKGROUND OF THE INVENTION

The present invention relates to a video display apparatus and method for displaying the power saving modes for use with a computer monitor.

In order to reduce power consumption, computer monitors have been designed having a power-save mode that is automatically selected after the monitor has been on, but not in use, for a long period of time. Industry standards have been developed, for example, the standard made by VESA (Video Electronics Standards Association) in the U.S.A., requiring a computer monitor to be operated in four power-save modes: "on-mode", "standby mode", "suspend mode" and "active-off mode". The on-mode is used when the computer monitor is displaying a picture, and the other modes are used when no picture is displayed. As the modes are changed under control of the computer from the on-mode, to the standby mode, to the suspend mode, and to the active-off mode, in that order, the number of operating circuits is reduced and the power consumption is lowered.

Each mode of the computer monitor is set under computer control based on the sync signals contained in a video signal supplied to the display apparatus. Specifically, when a horizontal sync signal and a vertical sync signal are transmitted together with a video signal, the display apparatus is placed in the on-mode, thereby displaying a picture based on the video signal.

When the horizontal sync signal is not transmitted and only the vertical sync signal is, the display apparatus is placed in the standby mode where most circuits are energized. In this mode, when the transmission of the video signal and the horizontal sync signal is resumed, the display apparatus is switched to the on-mode, thereby immediately resuming the display of a picture.

When the vertical sync signal is not transmitted and only the horizontal sync signal is transmitted, the computer monitor is placed in the suspend mode where only the heater of the cathode ray tube (CRT) and the circuits making up the control system are energized. In this mode, when transmission of the video signal and the vertical sync signal is resumed, the display apparatus is switched to the on-mode, thereby resuming the display of a picture in a relatively short period of time.

When neither the horizontal sync signal nor the vertical sync signal are transmitted, the computer monitor is placed in the active-off mode where only a minimum number of the circuits of the control system are energized. In this mode, when the transmission of the video signal and the sync signals are resumed, the display apparatus is switched to the on-mode, thereby resuming the display of a picture after a relatively long period of time.

Therefore, the power consumed when the display apparatus is not in use can be optimized by a plurality of power save modes. Also, once the computer monitor is placed in the active-off mode, it cannot be returned to the on-mode until the power-supply switch is operated.

Finally, the suspend mode is an optional mode in the above mentioned VESA standard. Only the on-mode, standby mode, and active-off modes are required modes.

A monitor having a plurality of power-save modes has to display its current operation mode. Since these power-save modes are used when a picture is not displayed, these power-save modes cannot be displayed pictorially on the picture screen. Therefore, the current operation mode of the computer monitor is displayed on a dedicated display unit including light-emitting diodes or a liquid-crystal panel.

Considering that the power-save modes are intended to lower power consumption, a minimum amount of power should be consumed in order to display their status. For example, a method for displaying power saving modes using four light-emitting diodes accomplishes a low power consumption since the four light-emitting diodes are provided for the four modes, only one of them is energized at a time.

If four light-emitting diodes are used solely to display the operation modes, however, the computer monitor design becomes complex. Also, since the computer monitor needs space for placing the four light-emitting diodes, the computer monitor becomes unnecessarily large in size.

SUMMARY OF THE INVENTION

It is an object of the present invention to provide a video display apparatus and method for displaying power saving modes where the power saving modes can be displayed easily with low power consumption in a limited space.

This and other objects, advantages, and features of the present invention will become apparent to those skilled in the art upon consideration of the following description of the present invention.

According to a first aspect of the present invention, a video display apparatus having a plurality of power-save modes is provided which includes a display element for emitting light of at least two colors and circuitry for controlling the period of light emission of each color to correspond to the different power saving modes.

According to a second aspect of the present invention, a method for displaying power saving modes of a video display apparatus having a plurality of power saving modes by using a display element capable of emitting light of at least two colors is provided which includes the steps of detecting a power-save mode among the plurality of power-save modes and varying the period of light emission of each color to correspond to the different power-save modes.

DETAILED DESCRIPTION OF THE INVENTION

Figure 1:
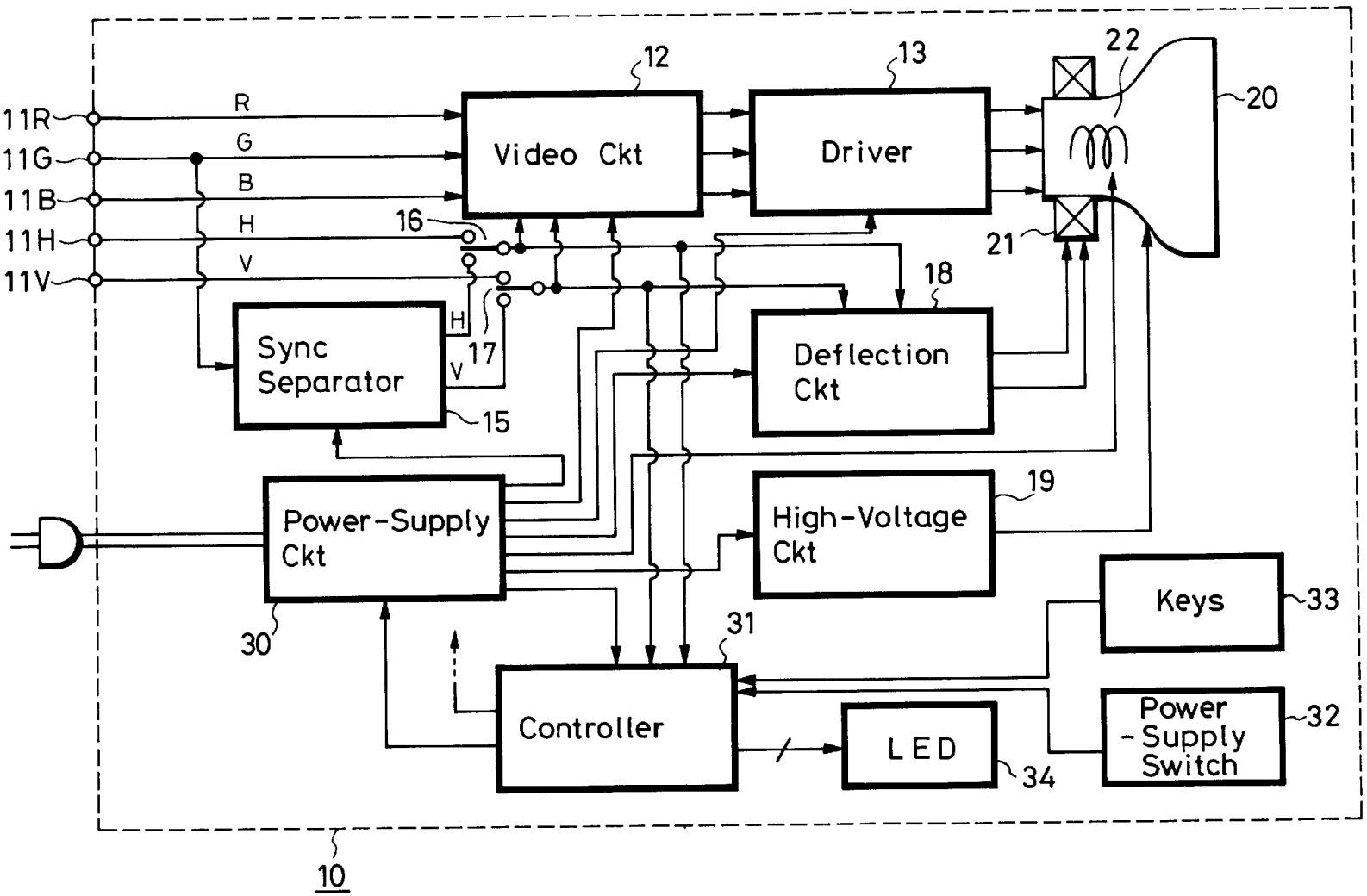
FIG. 1 is a schematic in block diagram form of a computer monitor according to an embodiment of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawing.

Turning now to FIG. 1, the present invention is used in a multiscan monitor, which is a monitor capable of processing and displaying an input video signal having one of several different horizontal frequencies.

A computer monitor 10 according to an embodiment of the present invention includes video signal input terminals 11R, 11G, 11B respectively supplied with video signals by a computer (not shown) representing the three primary colors, a red video signal R, a green video signal G, and a blue video signal B. Also, supplied by the computer and separated from the video signals, the computer monitor 10 includes a horizontal sync signal input terminal 11H and a vertical sync signal input terminal 11V. The red video signal R, the green video signal G, and the blue video signal B are supplied to a video circuit 12. The video circuit 12 receives and processes the R, G, B video signals at a timing synchronized with the horizontal and vertical sync signals.

The monitor according to the present invention can be used in a so-called sync-on-green system in which the green signal G having the horizontal and vertical sync signals superimposed thereon is transmitted as the video signal from the computer. In the case of a sync-on-green system, the signal applied to the input terminal 11G is supplied to a sync separator 15, and the sync separator 15 separates the horizontal sync signal H and the vertical sync signal V from the green signal G. Then, the horizontal and vertical sync signals H and V thus separated are switched by change-over switches 16 and 17 to replace the horizontal and vertical sync signals from the sync signal input terminals 11H and 11V and used in downstream circuits.

The video circuit 12 supplies the processed R, G, B video signals to a drive circuit 13 that drives a cathode-ray tube ("CRT") 20 for displaying an image on the screen of the CRT 20.

The horizontal sync signal H and the vertical sync signal V are supplied to a deflection circuit 18, and deflection currents that are generated based on the horizonal and vertical sync signals H, V are supplied to a deflection coil 21.

A high voltage generated from a high-voltage circuit 19 is supplied to a high-voltage electrode of the CRT 20. Power from a power-supply circuit 30 is supplied to the heater 22 of in the CRT 20 so that the electron beam can be properly emitted.

The power-supply circuit 30 generates a voltage by rectifying and transforming an AC voltage from a commercially-available power supply. The power-supply circuit 30 supplies corresponding voltages to the circuits in the monitor 10 including the video circuit 12, the driver 13, the sync separator 15, the deflection circuit 18, and the high-voltage circuit 19.

The power-supply circuit 30 supplies these voltages to the respective circuits under control of the controller 31, which is the system controller of the monitor 10, thereby controlling the circuits to which voltages are supplied in response to a power-save mode. In this embodiment, the horizontal sync signal H and the vertical sync signal V are supplied to the controller 31 through the change-over switches 16 and 17. The controller then uses the presence or absence of these signals to determine in which power-save mode to put the monitor 10 and to control the supply of power to the circuits based on this so determined mode.

For example, if the controller 31 detects the horizontal and vertical sync signals H and V, then it determines that the monitor 10 is in the on-mode and instructs the power-supply circuit 30 to energize all circuits including enabling the CRT 20 to receive and display images based on the input video signals.

If the controller 31 does not detect the horizontal sync signal H but does detect the vertical sync signal V, then it determines that the monitor 10 is in the standby mode and instructs the power-supply circuit 30 to energize all circuits and keep them in the energized state.

If the controller 31 does not detect the vertical sync signal V but detects the horizontal sync signal H, then it determines that the monitor 10 is in the suspend mode and instructs the power-supply circuit 30 to energize the power-supply source of the heater 22 of the CRT 20, the control circuit 31, and the surrounding power-supply sources.

If the controller 31 neither detects the horizontal sync signal H nor the vertical sync signal V, then it determines that the monitor 10 is in the active-off mode and instructs the power-supply circuit 30 to energize the control circuit 31, and the surrounding power-supply sources.

A power-supply switch 32, a plurality of operation keys 33 and a two-color light-emitting diode (LED) 34 are connected to the controller 31. Information entered by the user operating the power-supply switch 32 and by the user operating the operation keys 33 is supplied to the controller 31. The LED 34 is energized under control of the controller 31.

The monitor 10 is operated in each of the above-mentioned modes when the power-supply switch 32 is on. When the power-supply switch 32 is turned off, the monitor 10 is placed in the perfect off-mode where the supply of power to the circuits in the monitor 10 is stopped completely.

Although in this embodiment the power-supply circuit 30 is controlled by the power-supply switch 32 through the controller 31, in another embodiment the power-supply circuit 30 may be directly controlled by the power-supply switch 32. The operation keys 33 are used to adjust display parameters of the monitor 10.

The LED 34 according to this embodiment is provided for displaying the four power saving modes. The LED 34 could be, for example, a two-color light-emitting diode in which two light-emitting diodes for emitting light of different colors, for example, green and orange, are integrally housed in the same package.

Figure 2:
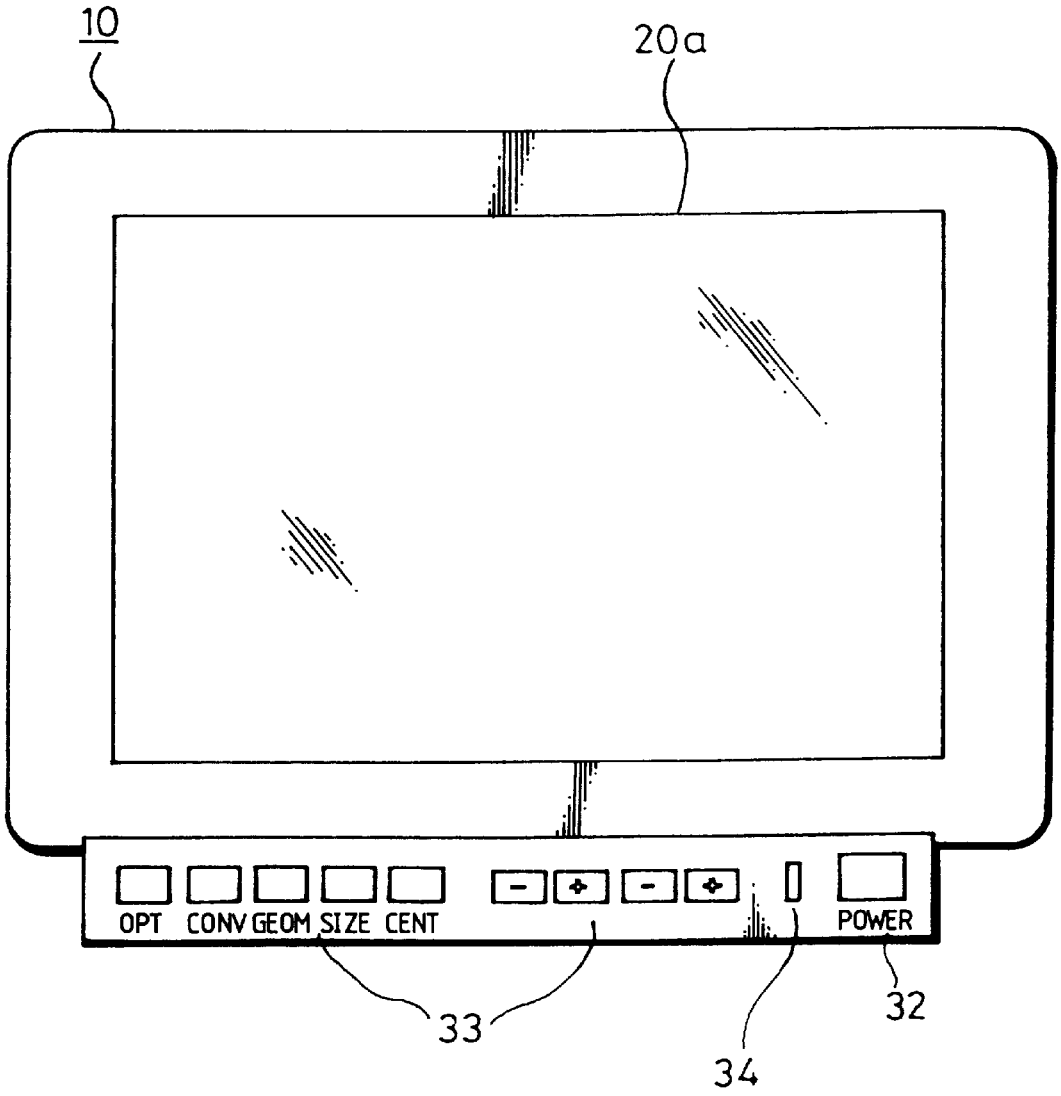
FIG. 2 is a front view of the computer monitor according to an embodiment of the present invention.

Turning now to FIG. 2, a display screen 20*a* including a cathode-ray tube (CRT) is placed at the center of the monitor 10, the power-supply switch 32 is placed at the lower right corner of the computer monitor and the LED 34 for displaying the monitor's power-save modes is disposed on the left-hand side of the power-supply switch 32. Also, a plurality of operation keys 33 are aligned with the power-supply switch 32 and the LED 34 on the front of the monitor 10.

Figure 3:
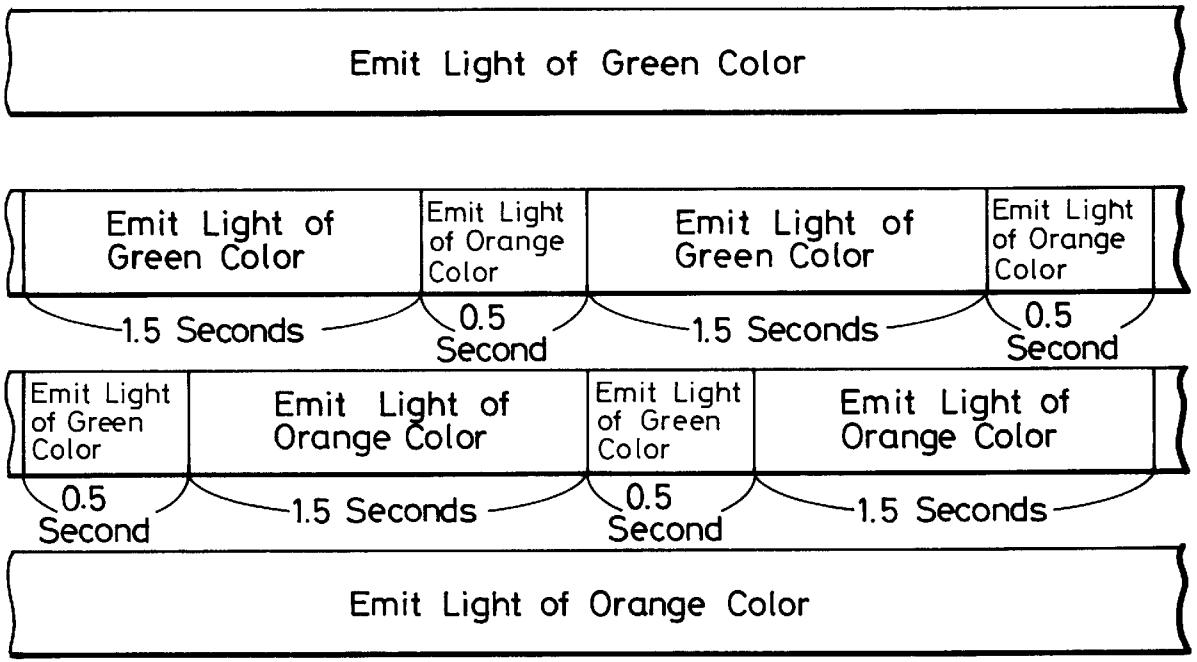
FIGS. 3A to 3D are timing charts showing the manner in which the light-emitting diode colors are energized to correspond to the respective power-save modes according to an embodiment of the present invention.

The manner in which the LED 34 displays the power-supply modes under the control of the controller 31 will be described is regard to FIGS. 3A to 3D. When the controller 31 puts the power-supply circuit 30 in the on-mode it directs the LED 34 to continuously emit green color light as shown in FIG. 3A. Next, when the controller 31 puts the power-supply circuit 30 in the standby mode, it directs the LED 34 to emit light of a green color for 1.5 seconds and then to emit light of an orange color for 0.5 seconds, repeating this cycle as shown in FIG. 3B. Then, when the controller 31 puts the power-supply circuit 30 in the suspend mode, it directs the LED 34 to emit light of green color for 0.5 seconds and then to emit light of orange color for 1.5 seconds, repeating this cycle as shown in FIG. 3C. Finally, when the controller 31 puts the power-supply circuit 30 in the active-off mode, it directs the LED 34 to continuously emit orange color light as shown in FIG. 3D. Thus, it is seen that the LED 34 produces two different shades of yellow, in addition to pure green and pure orange.

Figure 4:
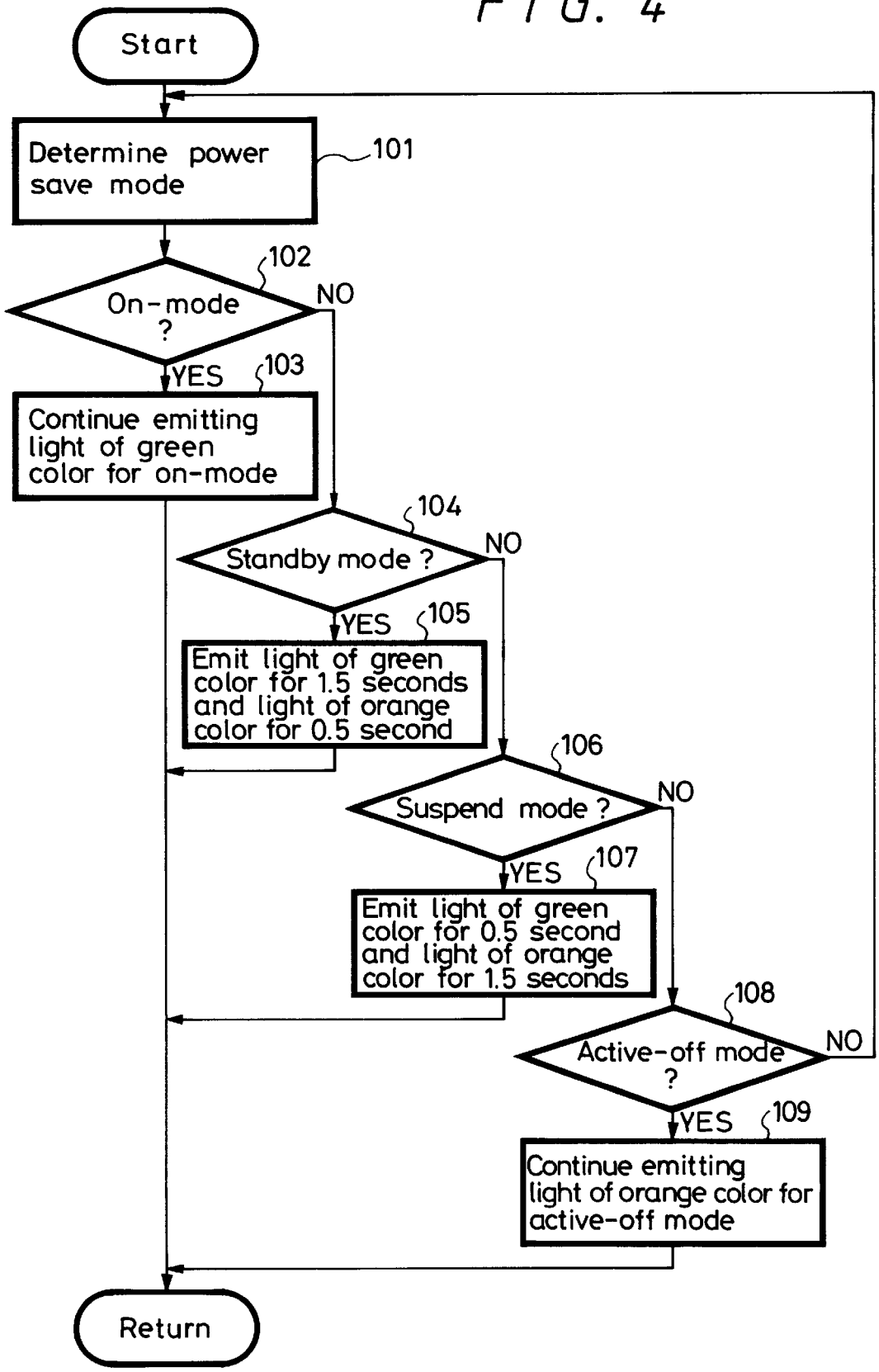
FIG. 4 is a flowchart of the method for displaying power-save modes, according to an embodiment of the present invention.

Turning to FIG. 4, the method for determining the power-save mode of the monitor and the control of the LED 34 by the controller 31 will be described. Following the start of operation, control goes to step 101 where the controller 31 detects the sync signals supplied to the monitor 10 and determines the power-save mode. Next, control goes to step 102 where the controller 31 decides whether the monitor 10 is in the on-mode based on detecting both the horizontal sync signal H and the vertical sync signal V. If the monitor 10 is in the on-mode, as represented by a YES at step 102, control goes to step 103 where the LED 34 is energized to continuously emit green color light as shown in FIG. 3A.

If the monitor 10 is not in the on-mode as represented by a NO at step 102, control goes to step 104 where the controller 31 decides whether the monitor 10 is in the standby mode based on a failure to detect the horizontal sync signal H and detecting the vertical sync signal V. If the monitor 10 is in the standby mode, as represented by a YES at step 104, control goes to a step 105 where the LED 34 cyclically emits green color light for 1.5 second followed by orange color light for 0.5 second as shown in FIG. 3C, thereby producing a greenish shade of yellow light.

If the monitor 10 is not in the standby mode, as represented by a NO at step 104, control goes to step 106 where the controller 31 decides whether the monitor 10 is in the suspend mode based on detecting the horizontal sync signal H but failing to detect the vertical sync signal. If the monitor 10 is in the suspend mode, as represented by a YES at step 106, control goes to step 107 where the LED 34 cyclically emits green color light for 0.5 second followed by orange color light for 1.5 seconds as shown in FIG. 3C, thereby producing an orangish shade of yellow.

Finally, if the monitor 10 is not in the suspend mode, as represented by a NO at the step 106, control goes to step 108 where the controller 31 decides whether the monitor 10 is in the active-off mode based on detecting neither the horizonal sync signal H nor the vertical sync signal V. If the monitor 10 is in the active-off mode, as represented by a YES at step 108, control goes to step 109 where the LED 34 is energized to continuously emit orange color light as shown in FIG. 3D.

As described above, the monitor 10 according to an embodiment of the present invention is able to display the four power saving modes of the power-supply using one two-color LED 34, thereby simplifying the monitor and reducing the space needed to indicate the presence of these modes.

Specifically, as shown in FIG. 2, one two-color LED 34 may be placed near the power-supply switch 32, thereby reducing the size of the monitor compared with the case where the monitor includes a number of LEDs corresponding to the number of powersave modes.

While in this embodiment the four power-save modes are displayed by a single display device as described above, the principle of the present invention can also be applied to the case where three power-save modes are desired, for example, where the suspend mode is not required. For example, when the monitor is in the standby mode, the LED could emit green color light for one second followed by orange color light for another.

Also, four power-save modes or more may be displayed by an LED capable of emitting light of two colors. For example, the light-emitting ratio of the two colors may be progressively changed in such a way that the light-emitting period of one color increases while the light-emitting period of the other color decreases as the power saving mode changes towards one having a lower power consumption.

While in this embodiment, an the LED is used as the display device, the display device is not limited to an LED and other light-emitting devices may be used as the display device. Also, the colors of light are not limited to the combination of green color and orange color and combinations of two other colors may be used.

In the above-described embodiment, the present invention is applied to a monitor using a CRT, however, the present invention is not limited to this and may be applied to monitors using other display means. Also, while the input video signals in this embodiment are the three primary color signals of red R, green G, and blue B as described above, the present invention may be applied to a monitor to which video signals of other system are the input.

While in this embodiment, the present invention is applied to a computer monitor, the present invention can also be applied to indicate the power-supply status of other video devices or to a variety of electronic devices having a plurality of power-save modes.

Thus, it is apparent that in accordance with the present invention an apparatus and method that fully satisfy the objectives, aims, and advantages is set forth above. While the invention has been described in conjunction with specific embodiments, it is evident that many alternatives, modifications, permutations, and variations will become apparent to those skilled in the art in light of the foregoing description. Accordingly, it is intended that the present invention embrace all such alternatives, modifications and variations as fall within the scope of the appended claims.

What is claimed is:

1. A video display apparatus having a plurality of selectable power-save modes, comprising:

a single display element for selectively emitting light of at least two colors for indicating one of said plurality of selectable power-save modes, wherein said plurality of selectable power-save modes includes a first mode in which power saving is at a first level and a second mode in which power saving is at a second level;

means for determining a power-save mode of said plurality of selectable power-save modes; and means for controlling said single display element such that respective light emitting periods of said at least two colors of said single display element correspond to each of said plurality of selectable power-save modes, wherein when said video display apparatus is in said first mode said at least two colors are alternately displayed at a first periodicity, when said video display apparatus is in said second mode said at least two colors are alternately displayed at a second periodicity, and when said video display apparatus changes from said first mode to said second mode said first periodicity gradually changes to said second periodicity.

2. The video display apparatus according to claim 1, further comprising power supply means controlled by said means for controlling such that said plurality of selectable power-save modes include a mode in which power saving is minimal and a mode in which power saving is maximum.

3. The video display apparatus according to claim 2, wherein said power supply means includes means controlled by said means for controlling such that said plurality of power-save modes further include a mode in which power saving is between said first mode and said second mode.

4. The video display apparatus according to claim 1, wherein said video display apparatus is a monitor having a cathode-ray tube.

5. The video display apparatus according to claim 4, wherein said video display apparatus is a multi-frequency monitor.

6. The video display apparatus according to claim 1, wherein said single display element is a two-color light-emitting diode (LED).

7. The video display apparatus according to claim 1, wherein said means for determining determines said power-save mode by detecting a presence or an absence of each of a horizontal sync signal and a vertical sync signal.

8. A method for displaying power-save modes to a user of a video display apparatus having a plurality of power-save modes by using a single display element emitting light of at least two colors, comprising the steps of:

displaying a current power-save mode of said plurality of power-save modes using said single display element, wherein said plurality of power-save modes includes a first mode in which power saving is at a first level and a second mode in which power saving is at a second level;

determining a power-save mode of said plurality of power-save modes; and controlling said single display element such that respective light emitting periods of said at least two colors of said single display element correspond to each of said plurality of power-save modes, wherein when said video display apparatus is in said first mode said at least two colors are alternately displayed at a first periodicity, when said video display apparatus is in said second mode said at least two colors are alternately displayed at a second periodicity, and when said video display apparatus changes from said first mode to said second mode said first periodicity gradually changes to said second periodicity.

9. The method according to claim 8, wherein said current power-save mode displayed by said single display element is detected based on a presence or an absence of each of a horizontal sync signal and a vertical sync signal.

10. The method according to claim 9, wherein said first mode is determined based on a presence of said vertical sync signal and an absence of said horizontal sync signal, said second mode is determined based on an absence of both said vertical sync signal and said horizontal sync signal, and a third mode, in which power saving is at a level between said first and second levels, is determined based on an absence of said vertical sync signal and a presence of said horizontal sync signal.

* * * * *